United States Patent [19]

Collin

[11] 4,437,314

[45] Mar. 20, 1984

[54] ATOMIZER NOZZLE FOR CONTINUOUS FUEL INJECTION

[75] Inventor: Karl-Heinz Collin, Wehrheim, Fed. Rep. of Germany

[73] Assignee: Klöckner-Humboldt-Deutz Aktiengesellschaft, Cologne, Fed. Rep. of Germany

[21] Appl. No.: 281,518

[22] Filed: Jul. 8, 1981

[30] Foreign Application Priority Data

Jul. 16, 1980 [DE] Fed. Rep. of Germany ..... 3026832

[51] Int. Cl.[3] ..... F02C 7/18

[52] U.S. Cl. ..... 60/738; 239/427.5; 239/434; 261/78 R; 261/78 A; 431/354; 431/352

[58] Field of Search ..... 239/427.5, 427.3, 428, 239/431, 434, 421; 261/78 R, 78 A; 431/265, 354, 353, 352; 60/737, 740, 738

[56] References Cited

U.S. PATENT DOCUMENTS

| | | | |
|---|---|---|---|
| 986,663 | 3/1911 | Weintz | 239/428 |
| 1,430,327 | 9/1922 | Sauer | 431/243 |
| 1,629,253 | 5/1927 | Breese | 431/63 |
| 1,849,125 | 3/1932 | Valjean | 431/63 |
| 1,864,647 | 6/1932 | Geer | 239/428 |
| 2,103,328 | 12/1937 | Hansen | 431/62 |
| 2,157,265 | 5/1939 | Pothier et al. | 431/243 |
| 2,701,608 | 2/1955 | Johnson | 431/353 |
| 2,796,118 | 6/1957 | Parker et al. | 431/353 |
| 3,150,708 | 9/1964 | Davis et al. | 431/352 |
| 3,779,694 | 12/1973 | Zagoroff | 431/352 |

FOREIGN PATENT DOCUMENTS

| | | | |
|---|---|---|---|
| 122807 | 8/1926 | Switzerland | 239/428 |

*Primary Examiner*—Samuel Scott
*Assistant Examiner*—Noah Kamen
*Attorney, Agent, or Firm*—Becker & Becker, Inc.

[57] ABSTRACT

An atomizer nozzle for continuous fuel injection is provided. The nozzle can serve as a main injection nozzle or as an igniter for combustion chambers, and is provided with a single-hole fuel nozzle, and an annular gap for possible additional air supply located coaxially therebefore. The chamber or space between the nozzle opening and the annular gap is connected by pressure equalization openings with the combustion chamber behind or after the annular gap. The pressure equalization openings are represented and defined by individual spacers between the fuel nozzle body and the air nozzle ring.

2 Claims, 4 Drawing Figures

ATOMIZER NOZZLE FOR CONTINUOUS FUEL INJECTION

The present invention relates to an atomizer or spray nozzle for continuous fuel injection, preferably in combustion chambers of gas turbines, and has a central nozzle body for fuel feeding, and an arrangement concentric thereto for annular air supply.

An atomizer nozzle of the indicated type is known according to which the air coming from the compressor is annularly guided in a nozzle concentric to the nozzle body; and a twist device located in the vicinity of the nozzle opening is supposed to effect an improvement of the atomization (German Offenlegungsschrift No. 15 01 934). Since the air and the fuel essentially move in the same direction, a swirling of fuel and air occurs at most in an external zone of the fuel stream or flow. The twist device creates a pressure loss without obtaining the intended effect.

It is an object of the present invention to provide a simple atomizer nozzle for continuous fuel injection which operates without movable parts and assures a high degree of atomization with little extra air.

This object, and other objects and advantages of the present invention, will appear more clearly from the following specification in connection with the accompanying drawings, in which.

Figure 1:
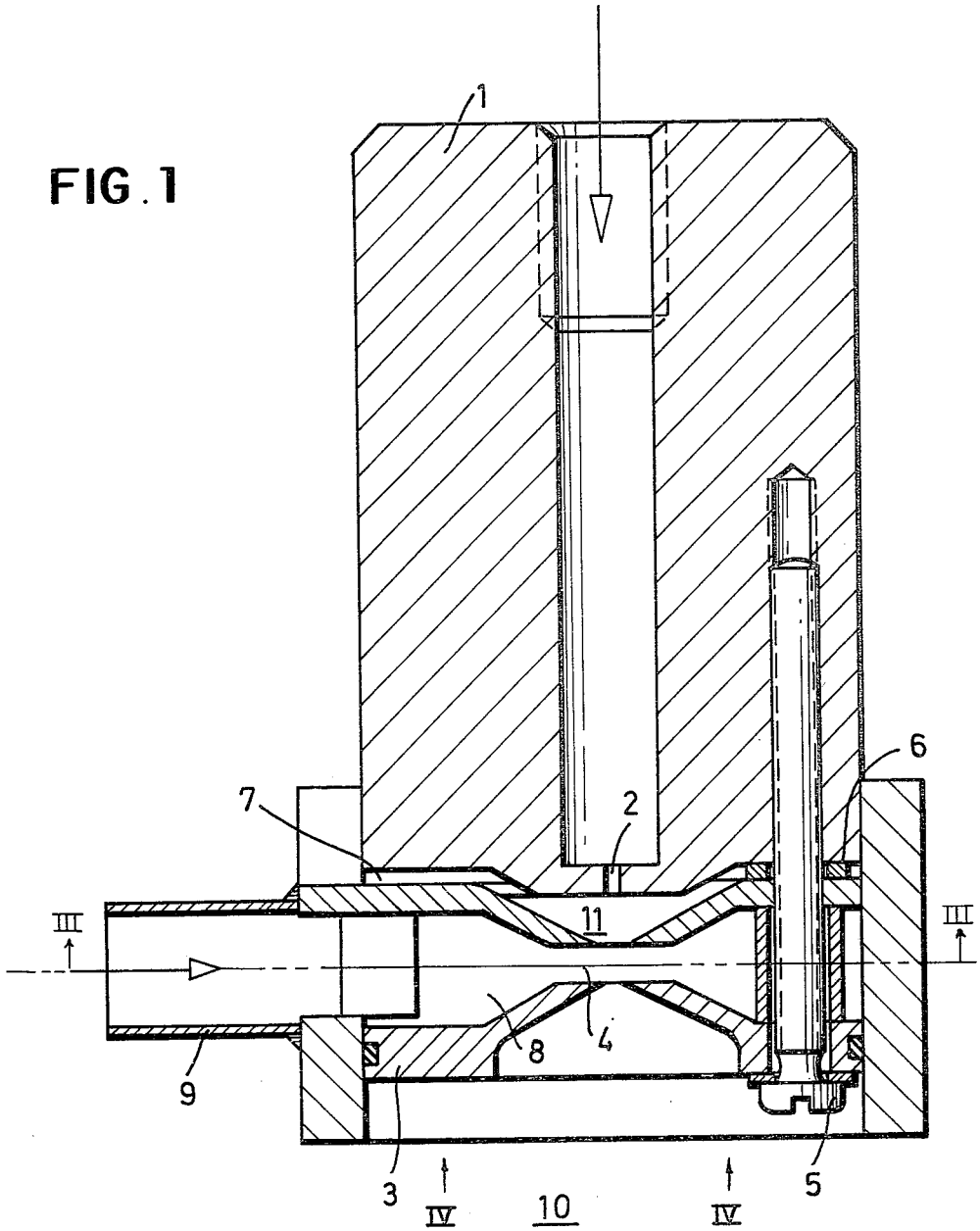
FIG. 1 is a section through an atomizer nozzle in accordance with the present invention.

The nozzle of the present invention is characterized primarily in that the nozzle body has a coaxial, open nozzle bore; in that the connection with the air supply comprises an annular body with an inner annular gap, which is arranged in a plane at right angles to the axis of the nozzle bore, whereby the air supply from the annular gap occurs in this plane and is directed radially symmetrically inwardly; in that the annular gap is arranged after the nozzle bore, in the direction of injection; and in that an inner chamber is provided between the nozzle bore and the annular gap, which inner chamber is connected with the surroundings by vents or pressure equalization openings.

The atomization of a fuel stream is based essentially upon the disturbance of the surface tensions of the liquid cylinder which forms after the stream leaves the nozzle bore. If for disturbing the surface tension, there is utilized an air stream which inventively discharges from an annular gap arranged around the free fuel stream, so that the air meets the fuel stream radially symmetrically in a perpendicular plane, then small quantities of air and a low air pressure, and hence a low air conveying capacity, are sufficient for atomizing a predetermined fuel quantity. An important feature of this atomization nozzle consists in that the fuel stream discharges into a chamber as a free stream, which chamber has the same pressure as the chamber in which the fuel vapor or mist is conveyed. For this purpose, the inventive pressure equalization openings are provided, by means of which the air conveying capacity necessary for atomization can be clearly reduced. While the known embodiments require 10 to 25 (W/g/s) conveying capacity for the fuel atomization, with the present inventive injection nozzle approximately 0.5 to 3.0 (W/g/s) suffices. The atomization of the liquid is so fine that a liquid mist results which is spread or dispersed by the supplied air. The spray or injection angle therefore results from the air and not from the direction of the fuel feeding.

With one specific inventive embodiment, the atomizer nozzle comprises an individual nozzle body with a central nozzle bore, and a separate annular body with an annular nozzle. During connection by means of screws or rivets, pressure equalization openings are formed between the two parts by the gaps between the spacers placed between or rigidly arranged on one of the parts.

The air supply is effective according to one special inventive embodiment by an annular nozzle which generates a well-defined stream with a narrowed gap. The atomizing effect can be further increased hereby.

If the injection nozzle is installed in combination with vaporizer tubes, as used on gas turbine annular combustion chambers, the generation of a fuel mist is only necessary in the starting phase. In all other drive mechanism operating conditions, the nozzle operates as a simple injection tube, so that the air supply inventively turned is off. The fuel vaporization is then taken over exclusively by the heated vaporizer tubes.

In accordance with specific features of the present invention, the annular gap may have a more restricted or narrower cross section than does an annular chamber in the annular body, whereby an annular nozzle is formed.

The annular body and the nozzle body may be separably or detachably connected with each other, whereby several spacers form pressure equalization openings therebetween.

With a vaporizer tube downstream in the combustion chamber, the nozzle, for injection of a smooth or even stream into the vaporizer tube, has a blocking device in the air supply conduit which is connected with the annular chamber in the annular body, whereby the air is shut off after the combustion chamber operating temperature is reached.

Referring now to the drawings in detail, the nozzle body 1 with the central nozzle bore 2, is connected by screws 5 with an annular body 3 having an annular gap 4. Spacers 6 in the form of washers are arranged between the nozzle body 1 and the annular body 3, as a result of which the vents or pressure equalization openings 7 are created. The annular body 3 has an inner annular chamber 8 into which an air supply circuit 9 opens or discharges. The pressure equalization openings 7 represent the connection of an inner chamber 11, which is located between the nozzle bore 2 and the annular gap 4, and the surroundings 10, such as a burner or combustion chamber, which is located externally of the annular body 3.

Figure 2:
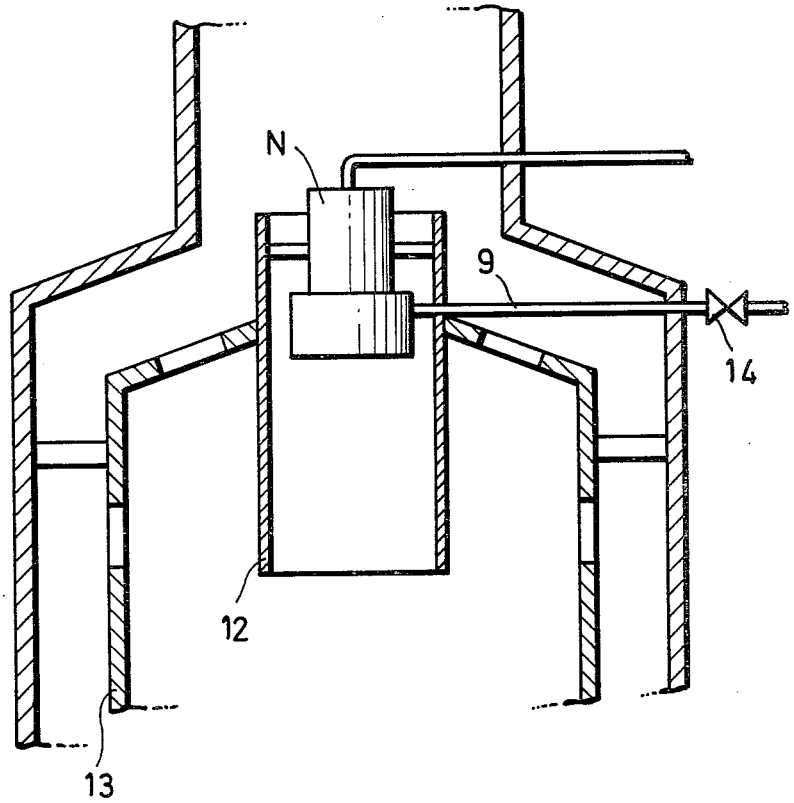
FIG. 2 shows the inventive atomizer nozzle installed in a vaporizer tube.
Figure 3:
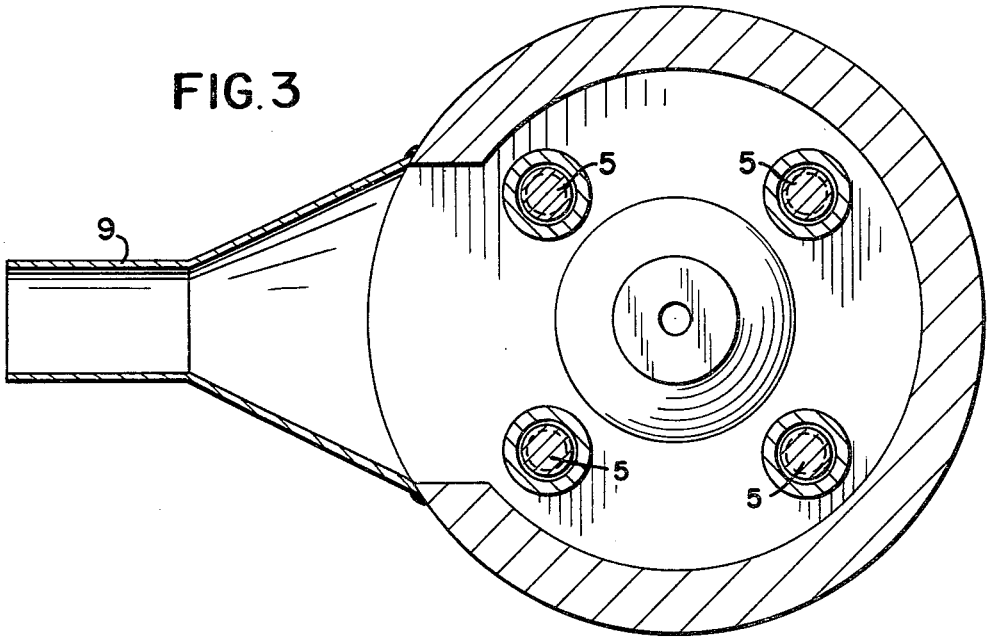
FIG. 3 is a cross section view taken along line III—III in FIG. 1.
Figure 4:
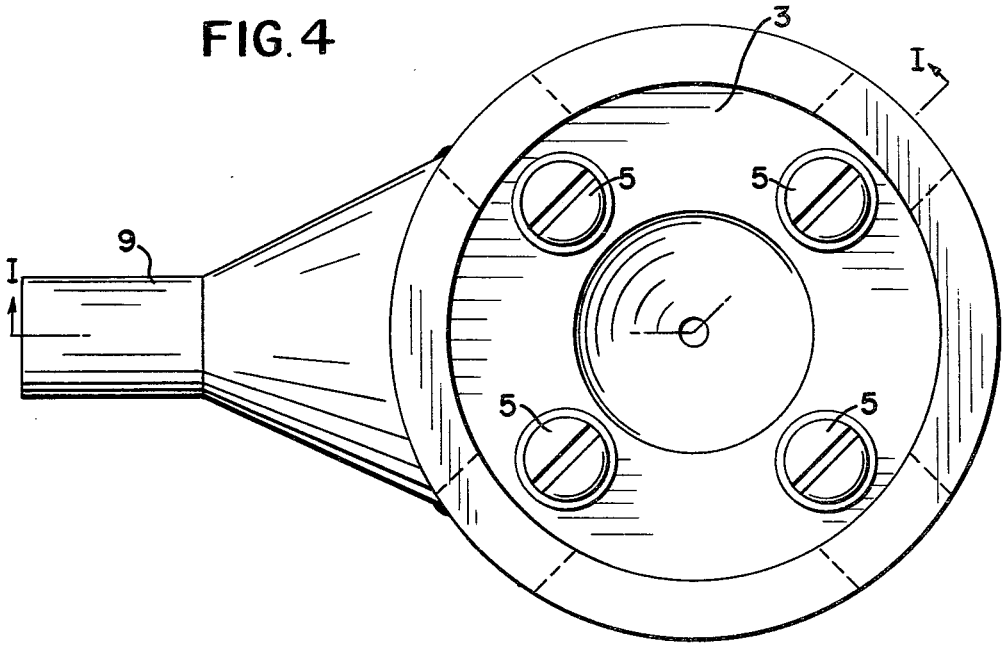
FIG. 4 is a view taken in the direction of arrows Iv in FIG. 1.

FIG. 2 shows the inventive atomizer nozzle N of FIG. 1 installed in a vaporizer tube 12, which in turn is arranged in a combustion chamber 13. In order to be able to shut off the air supply to the atomizer nozzle N once the operating temperature of the combustion chamber 13 has been reached, a blocking device or shut-off valve 14 is arranged in the air supply conduit 9.

The present invention is, of course, in no way restricted to the specific disclosure of the specification and drawings, but also encompasses any modifications within the scope of the appended claims.

What I claim is:

1. An atomizer nozzle arrangement specifically used for continuously injecting fuel into a combustion chamber of a gas turbine engine, wherein the nozzle atomizes the fuel without utilizing moving parts and with minimum utilization of intake air, the nozzle arrangement comprising in combination:

an air intake communicating with the combustion chamber;

a vaporizor tube within the combustion chamber;

a nozzle body positioned within the vaporizor tube in spaced relating therewith to define a space therebetween through which space a portion of the intake air passes; the nozzle body having a bore therethrough for delivering fuel therethrough, the bore having a fuel outlet of a smaller diameter than the bore, from which outlet a spray of fuel is ejected;

a circular chamber in the nozzle body and positioned downstream from the outlet, through which chamber the spray of fuel passes, the chamber having a back wall through which the outlet of the bore passes;

an annular body having a hollow interior and disposed in the circular chamber in spaced relation to the back wall of the chamber to define a space between the back wall of the chamber and annular body; the hollow annular body having an axial opening coincident with the axis thereof which opening is aligned with but spaced from the outlet of the bore and through which the spray of fuel and air from said hollow annular body pass; the hollow annular body having a front wall and a rear wall each of which have concave portions adjacent the axial opening;

an opening communicating the space between the back wall of the chamber and the annular body with the space between the vaporizor tube and nozzle body for pressure equalization;

an air supply conduit connected radially with the interior of the hollow annular body for supplying pressurized air thereto, and means for interrupting air flow through the air supply conduit so that the air supply can be stopped when the temperature of the combustion chamber reaches operating temperature.

2. The atomizer nozzle arrangement of claim 1 wherein the annular body is secured to the back wall of the nozzle body by a plurality of screws and wherein the space between the annular body and back wall of the chamber is created by space washers disposed between the annular body and back wall.

* * * * *